United States Patent [19]

Dauvergne

[11] 4,178,125

[45] Dec. 11, 1979

[54] BUCKET-LESS TURBINE WHEEL

[76] Inventor: Hector A. Dauvergne, P.O. Box 884, San Leandro, Calif. 94577

[21] Appl. No.: 843,517

[22] Filed: Oct. 19, 1977

[51] Int. Cl.[2] ..... F01B 1/18

[52] U.S. Cl. ..... 415/80; 416/20 R

[58] Field of Search ..... 415/80, 81, 82, 83, 415/199.1; 416/20 R

[56] References Cited

U.S. PATENT DOCUMENTS

| | | | |
|---|---|---|---|
| 761,226 | 5/1904 | Hedlund | 415/199.1 |
| 935,046 | 9/1909 | McLaren | 415/80 |
| 1,109,133 | 9/1914 | Melchers | 415/199.1 |
| 1,329,626 | 2/1920 | Oman | 415/80 |
| 1,418,704 | 6/1922 | Green | 415/199.1 |
| 3,032,988 | 5/1962 | Kleckner | 415/80 |
| 3,372,906 | 3/1968 | Griffith | 415/80 |

FOREIGN PATENT DOCUMENTS

| | | | |
|---|---|---|---|
| 928200 | 11/1947 | France | 415/199.1 |
| 268677 | 4/1927 | United Kingdom | 415/80 |

*Primary Examiner*—Louis J. Casaregola
*Attorney, Agent, or Firm*—Bielen and Peterson

[57] ABSTRACT

A turbine designed for use with steam contaminated with corrosives, the turbine has a plurality of turbine wheels with a peripheral rim around which are symmetrically arranged a plurality of nozzles; steam supplied to the center of a wheel is directed outward at an angle from a tangent to the periphery of the rim, the wheels having a cooperating housing for redirecting the steam from the periphery of one wheel to the center of the next adjacent wheel, the turbine being constructed for directing wear primarily in the stationary housing and/or components which are inexpensive and easily replaceable.

18 Claims, 6 Drawing Figures

BUCKET-LESS TURBINE WHEEL

BACKGROUND OF THE INVENTION

The invention relates to a steam turbine and in particular to a design for a turbine wheel that is operable with contaminated steam. Steam turbines are generally constructed with multistage fans each having precision fabricated fan blades. The high initial cost of fabricating the precision blades restricts the driving medium to one that is non-corrosive, either chemically or mechanically. In this manner, maintenance and replacement is minimized in order that the high initial cost can be returned.

In certain circumstances, however, it is a worthwhile tradeoff to exchange the highly efficient blade turbine for a less efficient alternative turbine if an otherwise undesirable power source can be utilized. For example, in tapping natural geothermal steam sources, the steam is often contaminated with sulphur compositions which generate sulphuric acid and other corrosive compounds. Similarly, in tapping the heat source of molten rock in volcanic flues or the magma below the earth's crust by the forced introduction of water where a closed heat exchange system is not utilized, the steam generated is contaminated by corrosives. Again a turbine system for production of mechanical or electrical that can withstand the corrosive effect of the steam is necessary.

Even in engine systems where combustion products of conventional fuels mixed with steam generated from the injection of water, the resultant gas mixture is more corrosive than either the combusted gases or steam alone, thus requiring other than conventional fan-type turbines.

In such situations, a turbine that is designed to withstand corrosive, contaminated steam, and is designed for easy replacement of the elements defining the nozzle passages is desired. The bucket-less turbine wheel of this invention is devised for utilization of a contaminated drive medium.

SUMMARY OF THE INVENTION

The bucket-less turbine wheel of this invention is devised to operate with somewhat less efficiency of the fan-type steam turbine, but is able to operate for extended periods of time with a contaminated steam containing either corrosive gases or particulate matter.

The turbine wheel is constructed utilizing a flywheel principle such that material loss by corrosion in peripherally arranged nozzles will be negligible compared with the overall mass of the wheel and, thus not have any adverse effect on the balance and stability of the wheel. In fact, the major corrosive effect will be directed at a stationary shroud circumferentially encompassing the wheel. The shroud redirects the flow of gas and through the virtual reversal in the flow direction, incurs the major corrosive effect of the steam mix. The shroud need be replaced only after errosion upsets the expansion and the turbine efficiency. Being stationary, the shroud errosion will not upset the dynamic characteristics of the wheel.

Rotating nozzles are incorporated directly in the periphery of a solid wheel or alternately in inserts that are inserted in key slots around the periphery of the wheel, enabling selective replacement of individual nozzles. The nozzles direct an accelerated gas flow from within the wheel outwardly at a select angle approaching the tangent to the wheel periphery. The reaction from the expelled fluid imparts a rotation to the wheel.

To fully utilize the pressure differential between the steam generator, and atmosphere at conventional operating temperatures, the bucket-less turbine wheel should be constructed as a multi-stage unit. In the multi-stage unit, the stationary "bucket" shroud is employed to redirect the fluid flow from outside the periphery of one wheel stage to an area within the periphery on the next adjacent wheel stage.

DETAILED DESCRIPTION OF THE PREFERRED EMBODIMENTS

Figure 1:
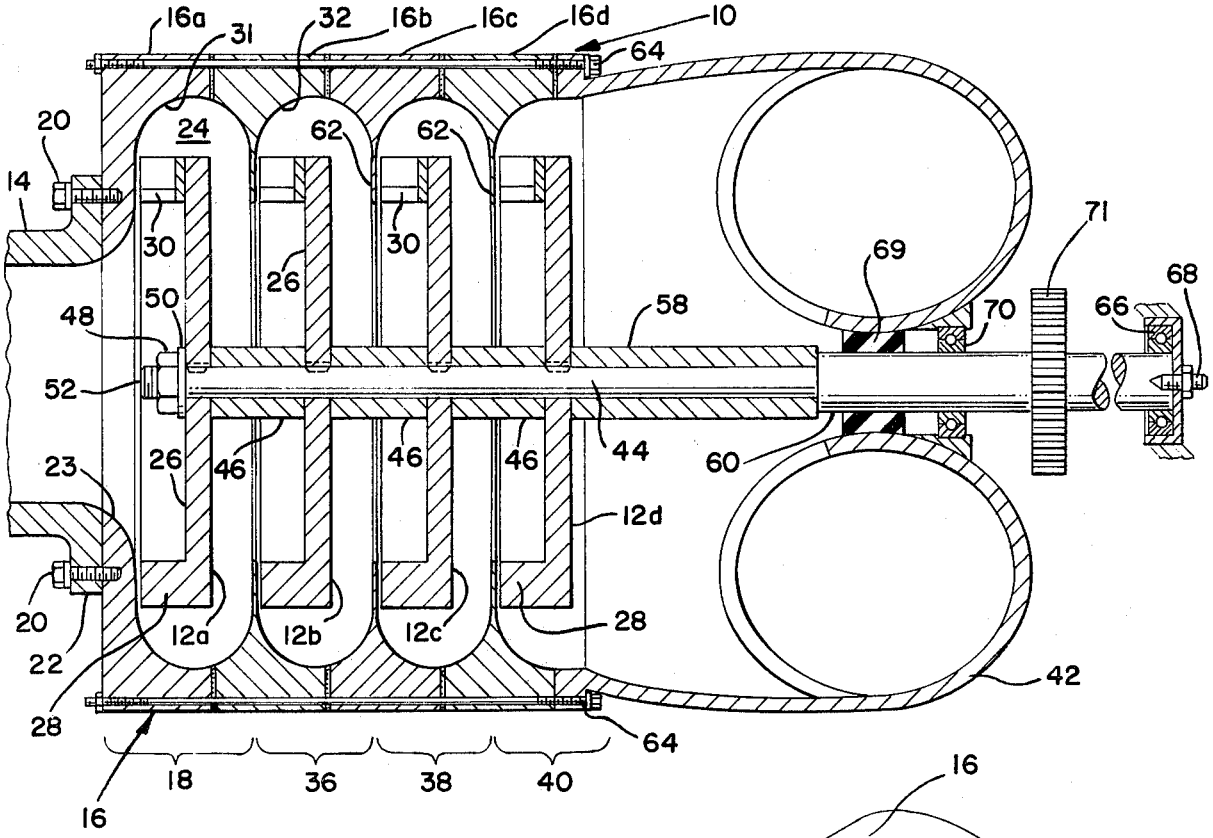
FIG. 1 is a cross sectional elevational view of a multi-stage turbine.

The turbine of this invention, designated generally by the reference numeral 10 in FIG. 1 is constructed with a plurality of bucket-less turbine wheels 12 at each of several stages in the turbine. While the most efficient turbine for many operational environments includes additional stages, the four stage turbine shown will provide an adequate exemplar to enable one skilled in the art to design a turbine suitable for the particular steam source conditions encountered. Since the turbine is designed particularly for utilization of contaminated steam, these source conditions may vary considerably, particularly where natural geothermal steam sources are tapped for power generation.

For a water injected combustion system utilizing a combustion gas and steam mixture as the turbine driving medium, an inlet pressure of approximately 75 psia and a temperature of 1800° F. is within an expected range. For such conditions, a six stage system would comprise an efficient utilization of the effective pressure differential.

The four stage turbine 10 of FIG. 1 includes an inlet conduit 14 connected at one end to a gas supply which, for example, comprises the outlet of a combustion burner (not shown) wherein water is injected to generate a steam and combusted gas mixture. The inlet conduit is connected to the first segment **16*a* of a segmented shroud 16 or housing at the first stage 18 of the turbine by bolts 20, fixing a flange 22 on the conduit to an annular extension lip 24 on the shroud segment 16*a*. The main body of the shroud segment 16*a* encompasses a disk-like turbine wheel 12*a*. The shroud segment includes an annular expansion area 24** juxtaposed to the circumference of the turbine wheel.

A concentric central portion 26 of the wheel **12*a* is hollowed such that an annular rim 28 is formed. Located within the rim is a set of nozzles 30** which direct an accelerated flow of gas outward through the rim at an acute angle from the geometric tangent to the circumference of the wheel. The ejected gas is directed into the expansion area around the periphery of the wheel and to the inner hollowed portion of the next adjacent wheel. The reactive effect from the ejected gas rotates the wheel.

The design of the wheel is simplified to facilitate fabrication and reduce costs such that replacement of even the entire wheel is not prohibitive. In this respect, a flat disk of a predetermined thickness is milled on one side to hollow a substantial portion of the center leaving a rim defined by an inner margin at the interface with the hollowed-out portion and the outer periphery, the rim having width and depth sufficient to incorporate the nozzles either as inserts, as in FIGS. 1 and 2 or as passages as in FIGS. 3–6.

The expansion area 24 is defined by the curved inner surface 31 of shroud segment 16*a* and the curved inner surface 32 of the adjacent shroud segment 16*b*. The curved inner surfaces are designed to redirect the flow of gas from a radially outward direction to a radially inward direction relative to the axis of rotation of the wheel. In this manner, the expanding gas is redirected to the open central portion 26 of the turbine wheel 12*b* of the next adjacent or second stage 36. The gas is again accelerated through a set of identical nozzles 30 in the periphery of the turbine wheel 12*b* and expanded in the expansion area between the second stage 36 and third stage 38. This process is repeated for each wheel 12*c*, 12*d* in each additional stage, until the final stage 40 (here the next adjacent stage) is reached. After the gas is ejected from the nozzles 30 in the periphery of the wheel 12*d* in the final stage, it is expelled into an exhaust manifold 42 fastened to the shroud segment 16*d* of the final stage 40. The exhaust conduit is connected to an appropriate discharge means to the atmosphere.

The segmented nature of the shroud as well as the uniform construction of the wheels, allow turbines having varying numbers of stages to be easily assembled. In this manner, steam sources varying in temperature and/or pressure can be utilized most efficiently.

The wheels in the multiple stages in FIG. 1 are connected to a common drive shaft 44. For easy assembly and disassembly, the wheels are separated by annular spaces 46 and secured to the shaft 44 by a nut 48 and washer 50 on the threaded terminal and 52 of the shaft. On the embodiment shown the wheels are additionally second by a key 54 and keyway 56 arrangement. An elongated spacer 58 abutting an enlarged portion 60 of the shaft, enables additional stages to be added if desired. By displacing the shaft and substituting wheel spacers for the elongated spacer 58, the modification can be easily accommodated. However, in the embodiment of FIG. 1, because of the inwardly directed shield portion 62 of shroud segments 16 the segments would have to be concurrently disassembled by unfastening the longitudinal clamping bolts 64 fastening the shrouds and the exhaust conduit together.

The shaft may be journaled at both ends, or, as shown, journaled at one end with a cap bearing 66 having a longitudinal adjustment screw 68, seal 69 and support bearing 70 such that the turbine wheels 12 are cantilever supported within the shroud on the elongated shaft.

Power can be extracted from a gear 71 mounted on the shaft which in turn is coupled to an extraneous drive train (not shown).

To minimize the weight of the turbine wheel assembly, the wheels may be fabricated from a lightweight element or alloy. The nozzles 30, as shown in the exploded view of FIG. 2, comprise a replaceable inset 72 and may be fabricated from an element or alloy that is specifically formulated for corrosive resistance and may thereby differ from the material of the wheel.

Figure 2:
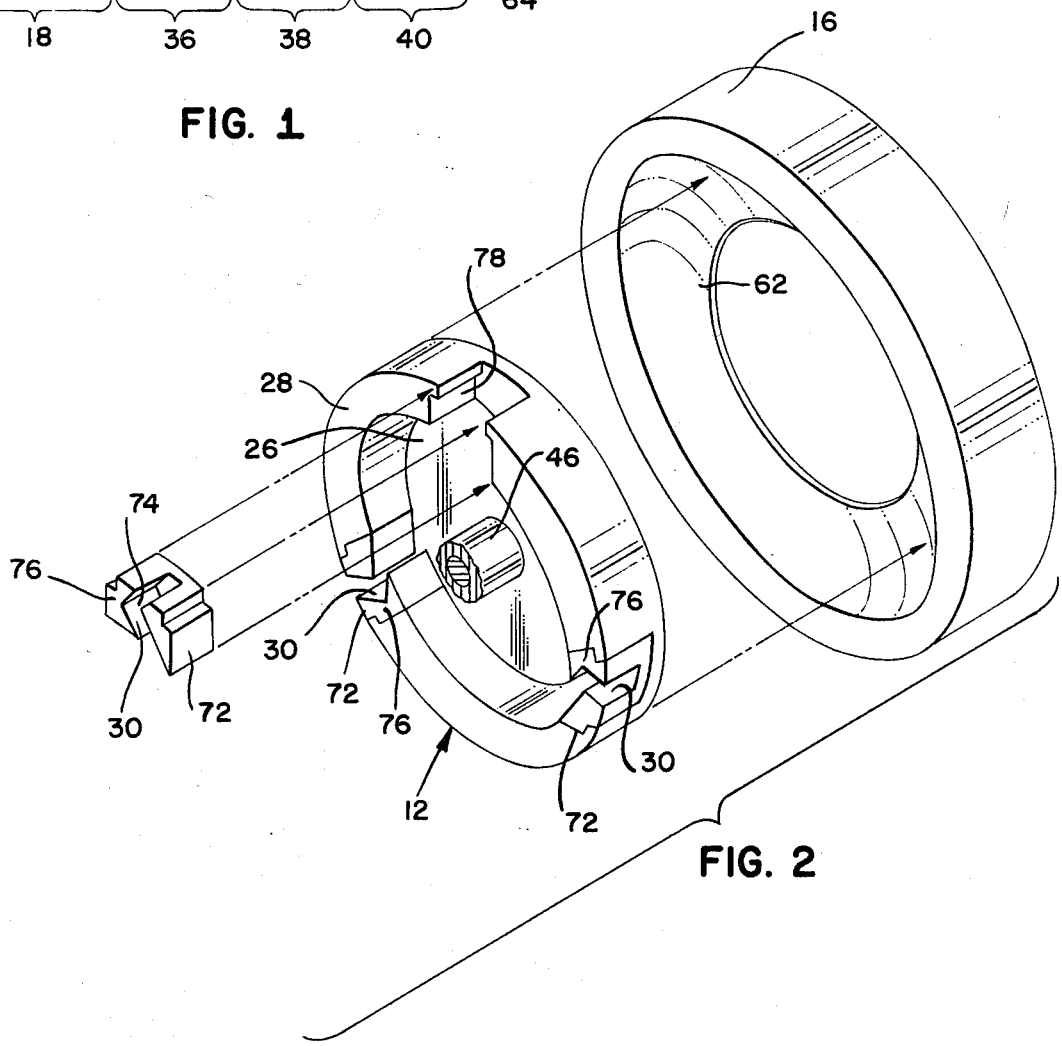
FIG. 2 is an exploded view of one stage of a multi-stage turbine of this invention.

Each nozzle 30 in the embodiment of FIGS. 1 and 2 is constructed with a crooked passage 74 which may be milled or formed by a casting or other process. Because the shield portion 62 of the shroud segments 16 extend over the face of the rim 28, the nozzle passage can be constructed in the inset open to the outer face 76. In this manner, the shield portion 62 forms a closure for the side of the nozzle passage.

The inset has a keyed configuration to allow it to engage a similarly configured cutout 78 in the rim 28 of the wheel and be retained therein.

While the external dimensions of the turbine wheels are the same for each stage of the turbine, the size number and orientation of the peripheral nozzles may be varied for maximizing efficiency in conformity with the conditions encountered.

Figure 3:
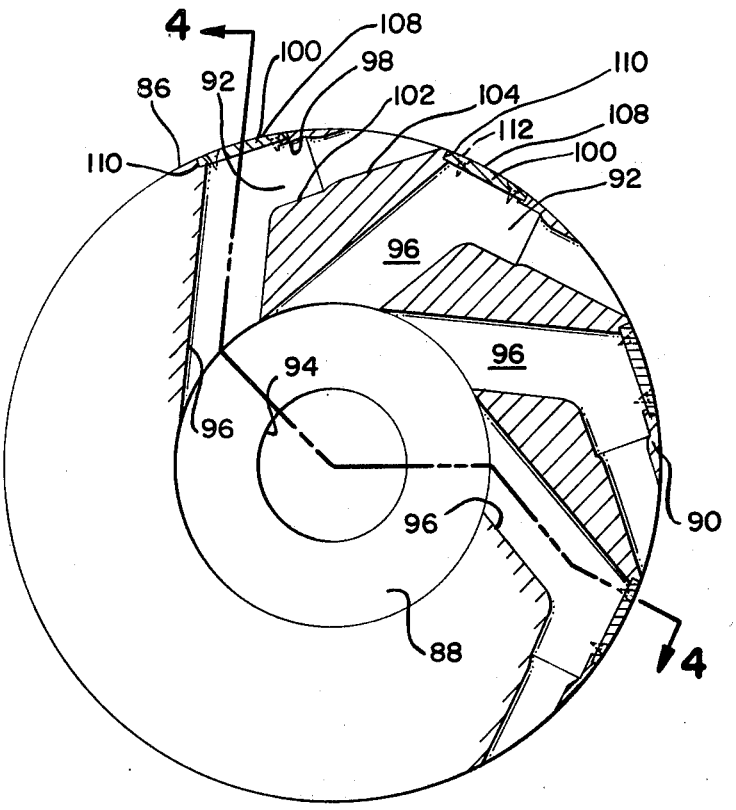
FIG. 3 is a cross sectional elevational view of an alternate embodiment of a turbine wheel.
Figure 4:
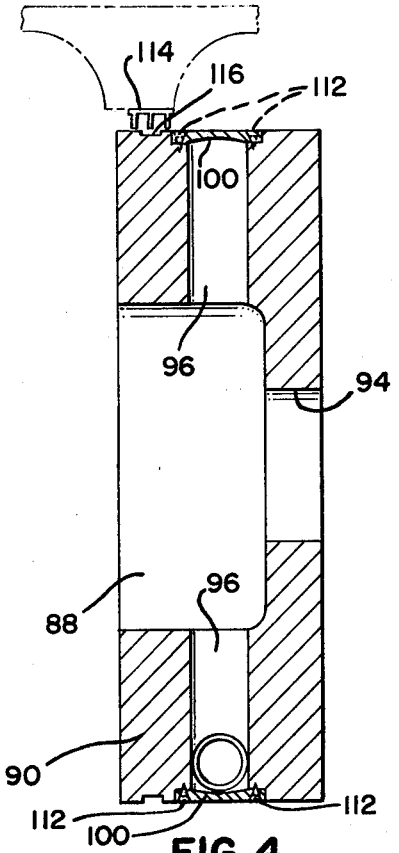
FIG. 4 is a cross sectional view taken on the lines 4—4 in FIG. 3.

Referring now to FIGS. 3 and 4, an alternate embodiment of the turbine wheel is shown. The wheel 86 is disk-like with a central hollowed out portion 88 defining a rim portion 90 in which a series of nozzles 92 are incorporated. The wheel includes a shaft hole 94 for mounting of a plurality of wheels on a common shaft in a housing similar to that shown in FIGS. 1 and 2. The nozzles are formed by a straight inlet passage 96 from the hollowed out portion 88 and an intersecting straight outlet passage 98. With the exception of a plug 100 capping each inlet passage at the periphery of the wheel, the wheel and nozzles are of a one piece construction. Constructing the nozzles from two straight passages enables each nozzle to be fabricated from two straight borings. The smaller outlet passage can be reamed in part through the uncapped opening of the inlet passage to create an enlarged initial section 102 which narrows at a throat 104 to a jet opening 106. The outlet passage 98 is directed along a centerline having approximately a 30° angle with a tangent to the wheel periphery. Preferably, the inlet has an angle from the radius of the wheel of 45°–60°.

The plug 100 may be rectangular in configuration and contoured on its outer face 108 to conform to the circumference of the wheel when the plug 100 is inserted in a recess 110 on the periphery of the wheel. The plug is fastened by small screws 112 in the corners of the plug 100.

The cross sectional view of FIG. 4 shows the wheel of FIG. 3, and a portion of an accompanying shroud. The shroud includes a deformable labyrinth seal 114 which cooperates with a groove 116 on the forward portion of the wheel rim to seal one stage from another. In this manner, the entire wheel assembly can be withdrawn from the housing without disassembling the shroud segments.

Figure 5:
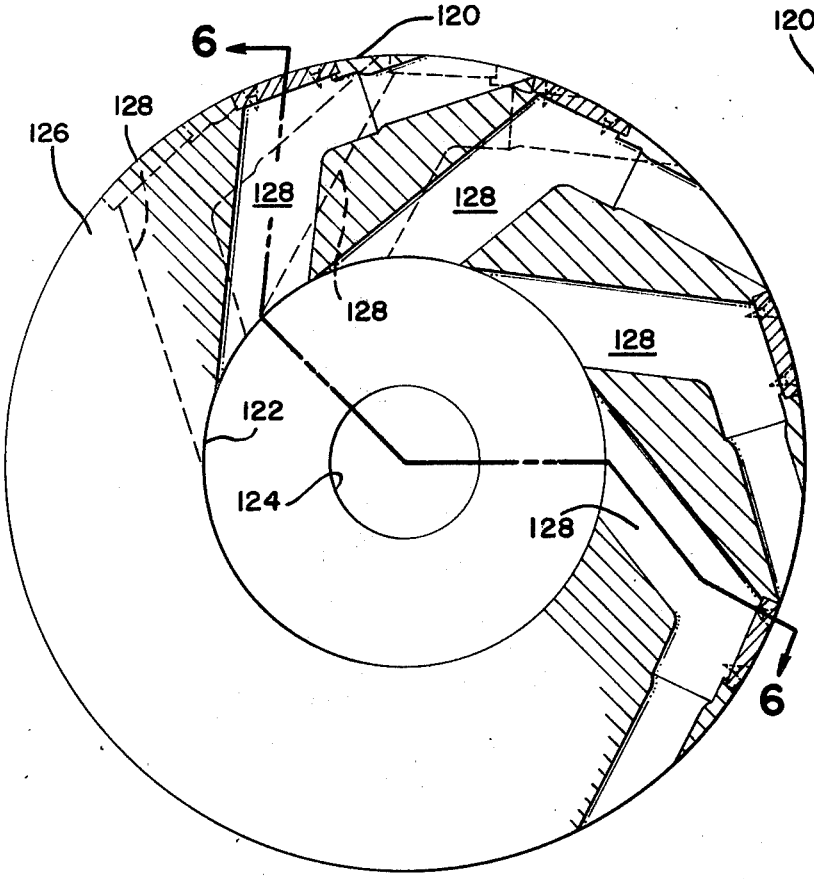
FIG. 5 is a cross sectional elevational view of a further alternate embodiment of a turbine wheel.
Figure 6:
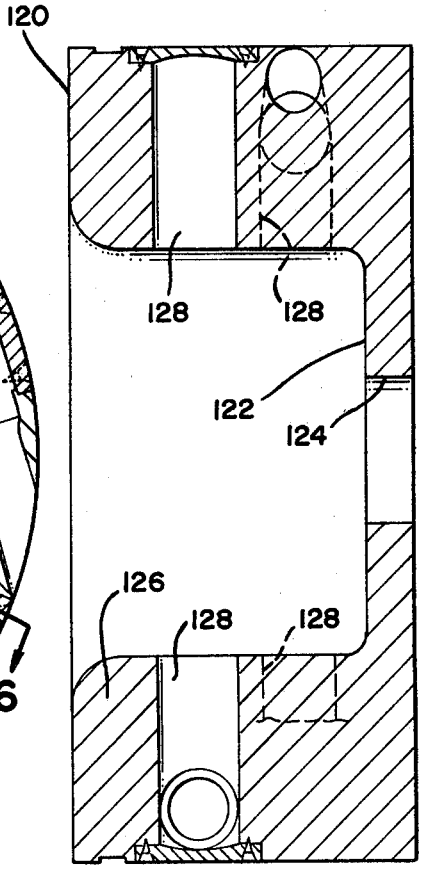
FIG. 6 is a cross sectional view taken on the lines 6—6 in FIG. 5.

The embodiment of the turbine wheel of FIGS. 5 and 6 are similar in construction to that of FIGS. 3 and 4. The wheel 120 has a hollowed out portion 122, a shaft hole 124 and a rim portion 126. The wheel 120 differs from the formerly described wheel by the dual set of nozzles 128 which are arranged on side by side planes in a staggered fashion. In such configuration, the wheel is essentially able to handle double the volume of steam at each stage.

Each of the embodiments is designed for fabrication by simple machining. Because of the high-corrosive environment intended for use, the turbine wheels are expected to be subject to wear. As noted, the particular design directs most of the wear on the non critical shroud segments. However, where wear in a wheel has so affected the performance of the turbine that it secures replacement, fabrication of a replacement wheel could, if necessary, be accomplished in any moderately equiped machine shop.

While in the foregoing specification embodiments of the invention have been set forth in considerable detail for purposes of making a complete disclosure of the invention, it will be apparent to those skilled in the art that numerous changes may be made in such details without departing from the spirit and principles of the invention.

What is claimed is:

1. A turbine wheel for use in a turbine comprising:

a flat disk having a hollowed concentric central portion on one side of said disk, an annular rim portion, said rim portion having an inner margin at an interface with the hollowed portion and an outer periphery displaced from said inner margin, and a plurality of nozzles symmetrically spaced around said rim portion said nozzles each comprising a passage through said rim portion from said inner margin to said periphery, said nozzles terminating at said periphery in a portion of said passage directed at an acute angle from a tangent to the periphery of said rim portion, wherein said nozzles each comprise a replaceable inset, said rim portion having a cutout in which said inset is installed.

2. A turbine wheel for use in a turbine comprising:

a flat disk having a hollowed concentric central portion on one side of said disk, an annular rim portion, said rim portion having an inner margin at an interface with the hollowed portion and an outer periphery displaced from said inner margin, and a plurality of nozzles symmetrically spaced around said rim portion said nozzles each comprising a passage through said rim portion from said inner margin to said periphery, said nozzles terminating at said periphery in a portion of said passage directed at an acute angle from a tangent to the periphery of said rim portion, wherein said nozzles each comprise a first substantially straight passage section directed generally radially outward from said hollowed central portion and a second substantially straight passage section approaching a tangential direction from the outer periphery of the rim portion, said first and second passages intersecting to form said passage through said rim portion, wherein said first passage section extends through said rim portion, said rim portion having a plug means flush with the outer periphery for capping the first passage section at the periphery, wherein said first passage section is diverted to said second passage section.

3. A turbine wheel for use in a turbine comprising:

a flat disk having a hollowed concentric central portion on one side of said disk, an annular rim portion, said rim portion having an inner margin at an interface with the hollowed portion and an outer periphery displaced from said inner margin, and a plurality of nozzles symmetrically spaced around said rim portion said nozzles each comprising a passage through said rim portion from said inner margin to said periphery, said nozzles terminating at said periphery in a portion of said passage directed at an acute angle from a tangent to the periphery of said rim portion, wherein said plurality of nozzles comprise a first nozzle set, said turbine wheel having a second nozzle set comprising a plurality of similar nozzles symmetrically spaced around said rim portion, said first nozzle set being arranged in a first section of the rim portion and said second nozzle set being arranged on a second section of the rim portion adjacent to and displaced from said first section.

4. The turbine wheel of claim 1 comprising a first turbine wheel in conjunction with a stationary shroud means and a similarly constructed second wheel having a common axis of rotation with said first wheel and having a hollowed out portion and rim portion with an inner margin and outer periphery, said shroud means having a curved inner surface around the outer periphery of the rim portion of the first turbine wheel and having sealing means for forming an expansion area communicating with the hollowed out portion of said second turbine wheel.

5. The turbine wheel of claim 4 wherein said sealing means comprises an inwardly directed shield extension of said curved inner surface of said shroud means terminating at said inner margin of said rim portion of said second turbine wheel.

6. The turbine wheel of claim 4 wherein said sealing means comprises a labyrinth seal on said shroud means cooperating with at least one groove on the outer periphery of said rim portion of said second turbine wheel.

7. The turbine wheel of claim 4 wherein said shroud means comprises multiple shroud sections, each section associated with two adjacent turbine wheels.

8. The turbine wheel of claim 7 in further conjunction with additional turbine wheels having a similar construction as said first and second turbine wheels, and with additional shroud sections complimenting each additional turbine wheel.

9. The turbine wheel of claim 2 comprising a first turbine wheel in conjunction with a stationary shroud means and a similarly constructed second wheel having a common axis of rotation with said first wheel and having a hollowed out portion and rim portion with an inner margin and outer periphery, said shroud means having a curved inner surface around the outer periphery of the rim portion of the first turbine wheel and having sealing means for forming an expansion area communicating with the hollowed out portion of said second turbine wheel.

10. The turbine wheel of claim 9 wherein said sealing means comprises an inwardly directed shield extension of said curved inner surface of said shroud means terminating at said inner margin of said rim portion of said second turbine wheel.

11. The turbine wheel of claim 9 wherein said sealing means comprises a labyrinth seal on said shroud means cooperating with at least one groove on the outer periphery of said rim portion of said second turbine wheel.

12. The turbine wheel of claim 9 wherein said shroud means comprises multiple shroud sections, each section associated with two adjacent turbine wheels.

13. The turbine wheel of claim 12 in further conjunction with additional turbine wheels having a similar construction as said first and second turbine wheels, and with additional shroud sections complimenting each additional turbine wheel.

14. The turbine wheel of claim 3 comprising a first turbine wheel in conjuction with a stationary shroud means and a similarly constructed second wheel having a common axis of rotation with said first wheel and having a hollowed out portion and rim portion with an inner margin and outer periphery, said shroud means having a curved inner surface around the outer periphery of the rim portion of the first turbine wheel and having sealing means for forming an expansion area communicating with the hollowed out portion of said second turbine wheel.

15. The turbine wheel of claim 14 wherein said sealing means comprises an inwardly directed shield extension of said curved inner surface of said shroud means terminating at said inner margin of said rim portion of said second turbine wheel.

16. The turbine wheel of claim 14 wherein said sealing means comprises a labyrinth seal on said shroud means cooperating with at least one groove on the outer periphery of said rim portion of said second turbine wheel.

17. The turbine wheel of claim 14 wherein said shroud means comprises multiple shroud sections, each section assocated with two adjacent turbine wheels.

18. The turbine wheel of claim 17 in further conjunction with additional turbine wheels having a similar construction as said first and second turbine wheels, and with additional shroud sections complimenting each additional turbine wheel.

* * * * *